US005382932A

United States Patent [19]

Monti

[11] Patent Number: 5,382,932

[45] Date of Patent: Jan. 17, 1995

[54] ELECTRONIC COMPONENTS AND SYSTEMS USING COAXIAL CABLE

[75] Inventor: Osvaldo Monti, Montreal, Canada

[73] Assignee: Canadian Marconi Company, Montreal, Canada

[21] Appl. No.: 114,902

[22] Filed: Sep. 2, 1993

[51] Int. Cl.[6] ..... H01P 1/00

[52] U.S. Cl. ..... 333/245; 333/260

[58] Field of Search ..... 333/202, 206, 207, 222–226, 333/236, 237, 243–245, 260; 174/260

[56] References Cited

U.S. PATENT DOCUMENTS 3,521,199 7/1970 Wehner ..... 333/207
4,004,257 1/1977 Geissler ..... 333/206 X
5,223,809 6/1993 Myer ..... 333/136 X

*Primary Examiner*—Seungsook Ham
*Attorney, Agent, or Firm*—Oblon, Spivak, McClelland, Maier & Neustadt

[57] ABSTRACT

A coaxial cable based electronic component or circuit is described. The circuit comprises one or more coaxial cables, each having an inner conductor which is surrounded by an insulating material and an outer conductive shielding sleeve is disposed about the insulating material. A window of predetermined size is made in the outer conductive shielding sleeve for access to the inner conductor for incorporating same as an integral part of an electronic component or circuit. The insulating material forms at least part of an electrically insulating support and electrical shield for the electronic circuit. The conductor has opposed terminal ends for connection thereto.

15 Claims, 4 Drawing Sheets

ELECTRONIC COMPONENTS AND SYSTEMS USING COAXIAL CABLE

TECHNICAL FIELD

The present invention relates to electronic components and systems using coaxial cable technology and wherein a window is formed in the outer conductive shielding sleeve of a coaxial cable for access to the inner conductor to connect electronic components to the inner conductor or to use the inner conductor as a circuit element in the construction of electronic components, such as filters, and further wherein the outer conductive shielding sleeve may serve as a support for the electronic circuit and components thereby eliminating the need for circuit boards or shielding housings, and further wherein the coaxial cable may be flexible or semi-flexible to permit space saving in the construction of the electronic circuit, or to fit in restricted space.

BACKGROUND ART

In my previous Canadian patent application Ser. No. 2,086,060 entitled "Broadband Directional Coupler Using Cables", I describe the construction of a broadband directional coupler formed by using commercially available coaxial cables which are semi-rigid and wherein I strip the shielding sleeve to expose a section of the inner cable which I then couple to another like section of cable to thereby form a coupler. This technique has many advantages over prior art techniques, such as being inexpensive to fabricate, it eliminates the need to produce expensive machined metal shielding housings, and provides flexibility in that the coupler can be shaped to many desired forms to save space, or to fit in a predetermined restricted space.

These advantages that I achieved with my broadband directional coupler led to further research and development in the use of flexible, semi-flexible or rigid coaxial cables, and I have now developed the coaxial cable technology to construct other components, such as filters, or to use the coaxial cable as the base for the construction of electronic circuits wherein I incorporate electronic components or chips directly coupled to the inner conductor in a window region of the cable. I have also developed economical means of providing housings about the strip regions or in the end portion of one or more of these cables wherein electronic circuits can be housed and shielded.

The fabrication of filters using classical technologies, such as a printed circuit board having lumped LC components, micro-strip, strip-line, etc., is known and it necessitates the use of various fabrication techniques and element sources. Such a construction is, for example, described in U.S. Pat. No. 4,835,499 issued May 30, 1989, entitled "Voltage Tunable Bandpass Filter". That patent describes a bandpass filter which is formed from a plurality of parallel resonators formed of micro-strips which are fitted on a circuit board and spaced with great accuracy. An advantage of such construction is that the resonators are simpler and less expensive to produce, but still occupy the space of the printed circuit board on which other components, such as tuning diodes and capacitors are coupled to the resonators. Such construction does not offer flexibility, nor is it useful in saving space, nor can it be designed to fit in a small predetermined area. These circuit boards also need to be shielded and must therefore be mounted in a shielded housing.

SUMMARY OF INVENTION

It is a feature of the present invention to provide a coaxial cable based electronic component or circuit which utilizes one or more coaxial cables and wherein a window is opened in the conductive shielding sleeve of the cables for access to the inner conductor for incorporating the conductor as an integral part of an electronic circuit or component.

Another feature of the present invention is to provide a coaxial cable based electronic component or circuit wherein the coaxial cable or cables form the support and shielded housing for the component or circuit.

Another feature of the present invention is to provide a coaxial cable based electronic component or circuit wherein the component or circuit is formed from flexible or semi-flexible coaxial cables permitting the component or circuit to be configured to minimize space or fit in a predetermined configured space.

Another feature of the present invention is to provide a coaxial cable based electronic component or circuit having increased performance, reduced weight, and which is relatively inexpensive to fabricate and which can be developed and constructed very quickly at reduced cost.

According to the above features, from a broad aspect, the present invention provides a coaxial cable based electronic component or circuit which comprises one or more coaxial cables, each having an inner conductor surrounded by an insulating material, and an outer conductive shielding sleeve about the insulating material. Open sections or windows of predetermined size are made in the outer conductive shielding sleeve for access to the inner conductor for incorporating the inner conductor as an integral part of an electronic component or circuit. The insulating material forms at least part of an electrically insulating support and electrical shield for the electronic circuit. The conductor has opposed terminal ends for connection thereto.

BRIEF DESCRIPTION OF DRAWINGS

A preferred embodiment of the present invention will now be described with reference to the examples thereof, as illustrated by the accompanying drawings in which.

DESCRIPTION OF PREFERRED EMBODIMENTS

Figure 1:
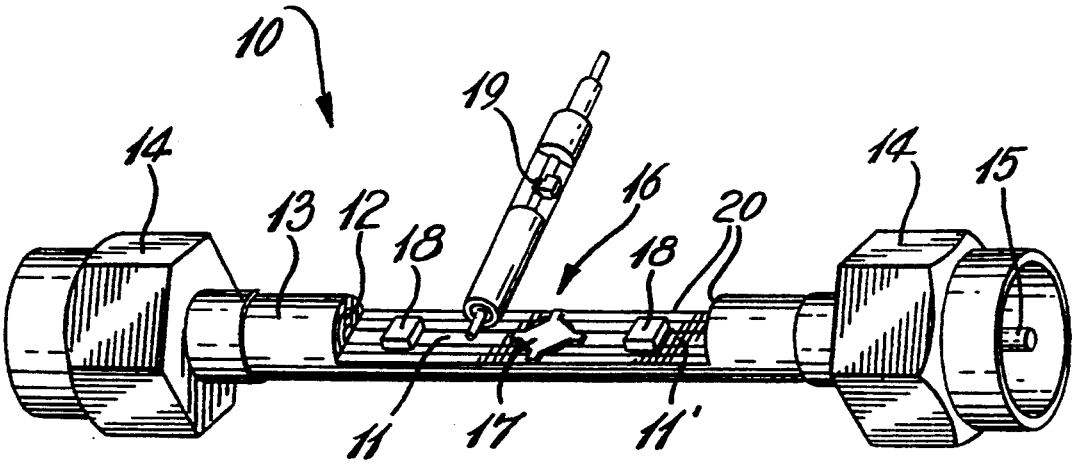
FIG. 1 is a perspective view illustrating a coaxial cable of the present invention utilized in the construction of an electronic circuit.

Referring to FIG. 1 there is shown generally at 10 a commercially available coaxial cable which is comprised of an inner conductor 11 surrounded by an insulating material 12, and an outer conductive metal electrical shielding sleeve 13. End connectors 14 are secured to the coaxial cable in a manner well known in the art. The connectors 14 provide access to the terminal end 15 of the inner conductor 11 for connecting thereto. As herein shown and in compliance with the present invention, the coaxial cable 10 forms an integral part or houses an electronic circuit 16 which is herein shown as comprised of a integrated circuit 17 which can be packaged as shown or unencapsulated, and other electronic components, such as capacitors 18, and a wire tap 19 which may feed a DC bias to the circuit, or act as a decoupler, is shown. The inner conductor 11 and part of the insulating material 12 are used as support and circuit connections for components 17 and 18 and to connect a supply (not shown) to the circuit 16. Once the circuit components are secured in position with the inner conductor 11, the window opening 20 which is formed in the cable 10 by stripping the shielding sleeve and insulation 12 and machining a surface 11' in the inner conductor, may be covered with an epoxy or other insulating material.

Figure 2:
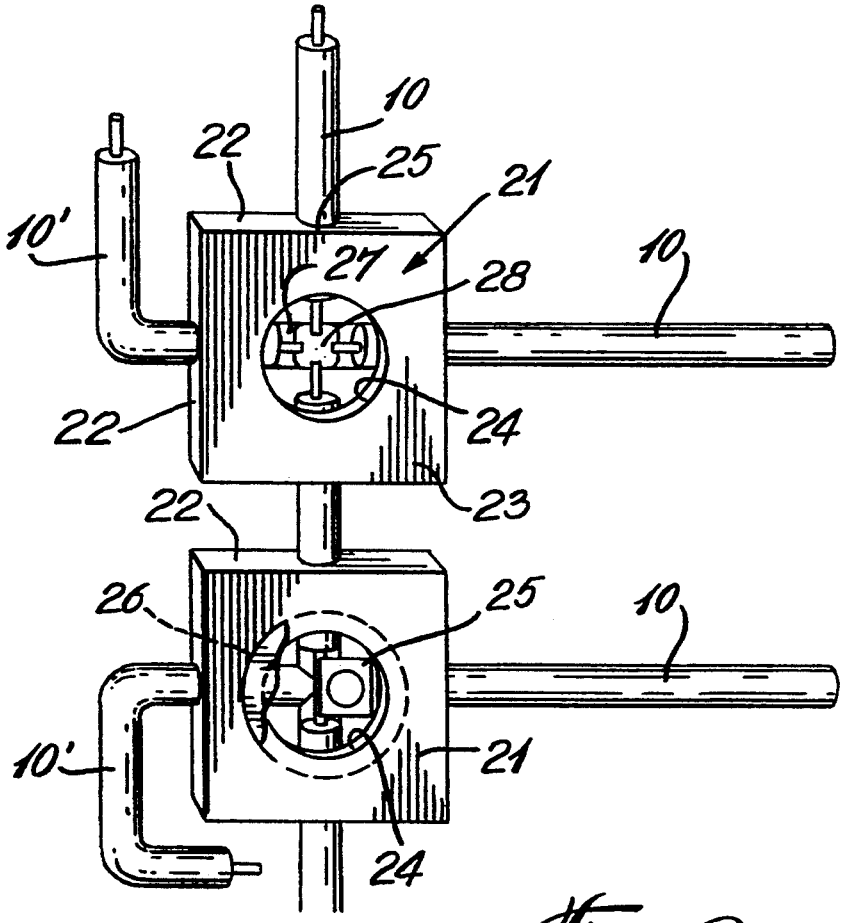
FIG. 2 is a further perspective view illustrating a plurality of coaxial cables utilized in the fabrication of an electronic circuit and wherein the circuit components are housed in one or more shielded housings which are formed by machining metal blocks.
Figure 2A:
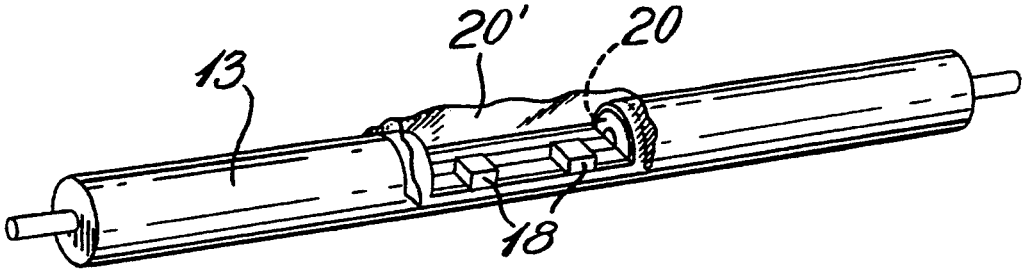
FIG. 2*a* to 2*c* are further perspective views illustrating alternative methods of providing shielding or protection of the circuits.
Figure 2B:
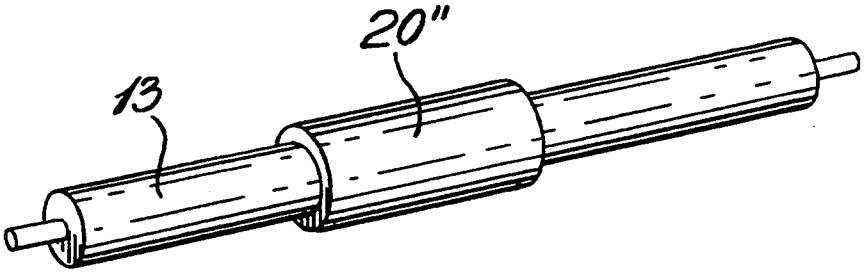
Figure 2C:
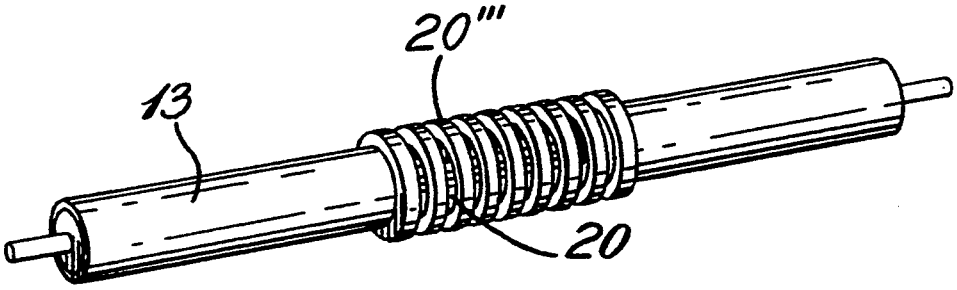

If it is necessary to shield the electronic circuit 16, as shown in FIG. 1, it may, for example, be mounted in a housing 21, such as shown in FIG. 2. The housing 21, as herein shown, simply consists of a metal block of rectangular shape having opposed side walls 22 and a top and bottom wall 23, and wherein a central transverse opening 24 or cavity is formed within the block between the top and bottom walls 23. Transverse cable receiving through bores 28 are formed in the side walls 22 for receiving coaxial cables 10 to lead them to the cavity 24.

As shown in FIG. 2, cables enter the transverse opening 24 and connect to an electronic component 25 located in the cavity, and the connection thereto can be made through the transverse opening of the cavity 24. Some of the cables, such as cables 10, are semi-rigid or flexible and may be bent or coiled or otherwise shaped to fit in a restricted space, or to occupy less space. As also shown in FIG. 2, a plurality of these housings 21 may be provided and various types of electronic components 25 may be connected within the cavities 24. After the circuit is constructed the cavities 24 can then be closed off by a cover, as shown by phantom line 26, which is welded or otherwise secured to the metal block housing 21. Accordingly, the housing 21 of the present invention is very economical to construct and provides easy assembly of the circuit components. To avoid any contact between the center conductor 11 and the shielding sleeve 13, a clearance 27 is made in the cables to avoid any risk of short-circuiting.

Alternative methods of shielding or protection are illustrated in FIGS. *2a–2c*. As shown in FIG. *2a*, the electronic components 18 locted in the window opening 20 is protected by an epoxy 20' which fills the opening 20. FIG. *2b* illustrates a shielding sleeve, herein a metal tube 20'', which is slid over the sleeve 13 and secured over the opening 20 such as by a weld (not shown). In FIG. *2c*, the shield is provided by a helically wound metal spring 20''' also secured over the window 20.

It can be seen from the examples of the coaxial based electronic circuits, as illustrated by FIGS. 1 and 2, that these circuits are easy to fabricate, small in size, and of low weight, and the shield 13 of the cable can be used instead of a shielding box to reduce weight, size and cost. Also, the cables can be bent or shaped to save space, and the cables can further eliminate the use of printed circuit boards, as the cables can be soldered together or to the shielding housing blocks 23.

With the coaxial cable technology of the present invention it is also possible to construct electronic circuit components, such as my coupler described in my copending patent application. I have also found that the coaxial cable technology can be used in the fabrication of filters, and this greatly simplifies the design, as well as the realization and optimization of the filters. The manufacture is greatly simplified and the costs are quite modest when compared with other existing filter construction technologies. The nature of the coaxial cable automatically provides the shielding and hermetic seal for the filter. Accordingly, with the present invention the filter no longer requires an exterior box or external shielding protection and, hence, there is considerable savings here, since certain manufacturing steps are no longer necessary. For the construction of an electronic circuit, I utilize precision mechanical machining capabilities to achieve quality performance for cutting the window in the shield and insulation as well as the machining of a platform on the center conductor.

The coaxial cable based technology of the present invention provides the design engineer the luxury of numerous filter designs and is extremely cost effective when compared to other existing technologies. This technology eliminates the necessity of having to design and fabricate fixtures which can also be expensive, particularly with the construction of high frequency filters. The filters constructed in accordance with this technology provide high reliability and excellent RF performance even when the filter is designed to fit in limited space where the printed circuit board area is limited.

Figure 4:
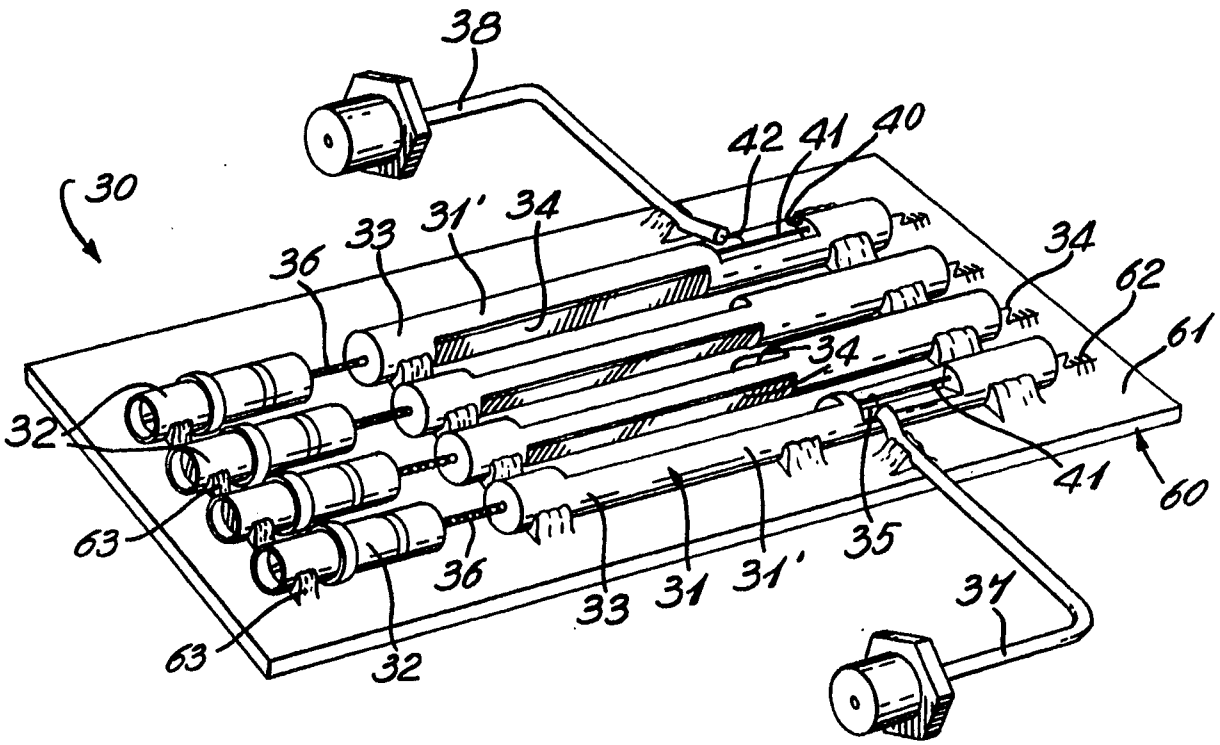
FIG. 4 is a perspective view showing the actual construction of the bandpass filter of FIG. 3.
Figure 3:
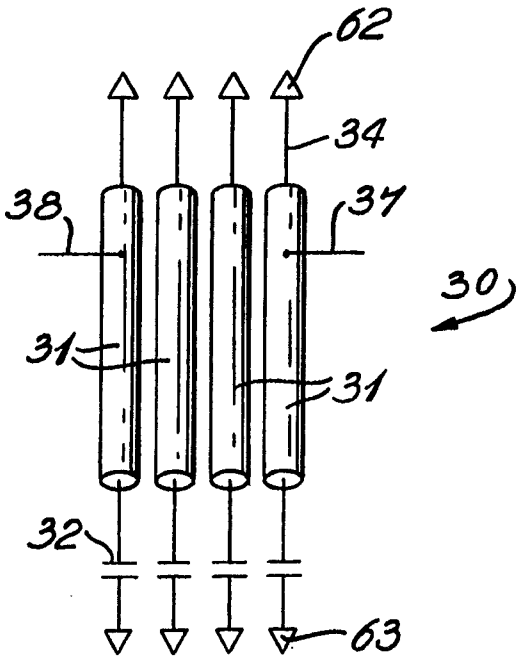
FIG. 3 is a schematic diagram illustrating the construction of a bandpass filter.
Figure 5:
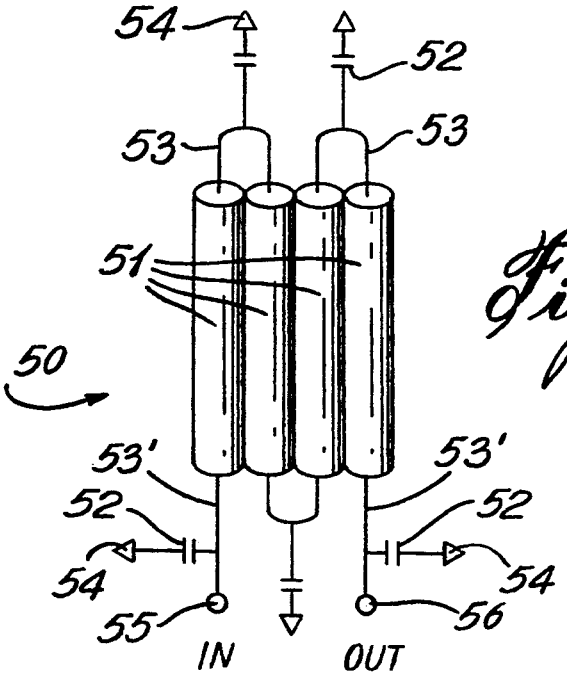
FIG. 5 is a schematic diagram of a low pass filter constructed in accordance with the coaxial cable technology of the present invention.
Figure 6:
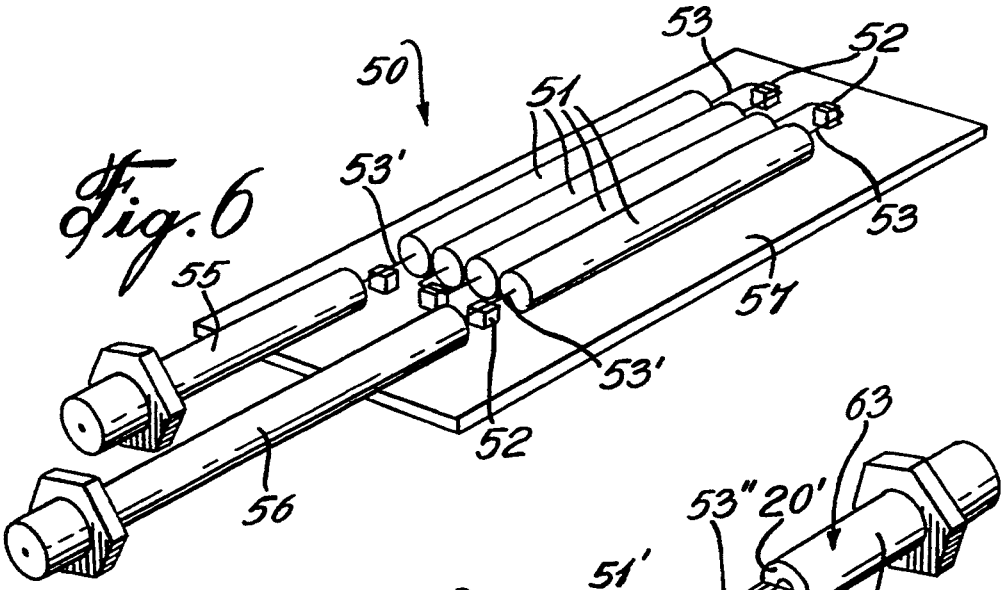
FIG. 6 is a perspective view showing the actual low-pass filter construction of FIG. 5.

With reference now to FIGS. 3 to 6, there is described two different types of filters constructed in accordance with the present invention, namely, a basic tunable bandpass filter, illustrated generally at 30 in FIGS. 3 and 4, and which comprises a plurality of parallel resonators 31 electromagnetically coupled through windows 34 and having tuning variable capacitors 32; and secondly a low-pass filter 50, as illustrated in FIGS. 5 and 6, consisting of sections of coaxial cables 51 and chip capacitors 52 coupled together.

Referring now more specifically to FIGS. 3 and 4, the construction of the tunable bandpass filter 30 will now be described. It consists of four coaxial cable sections 31 forming resonators. The resonators are formed by making windows or openings 34 in the shielding sleeves 33 so as to couple a precise length of the central conductor of these resonators together with the resonators being disposed in parallel relationship, as herein shown. The resonators are mounted on a board 60 having an outer conductive surface 61 or at least part thereof being conductive. The terminal end 34 of the central conductor 35 is welded to the conductive outer surface 61 of the board 60, as illustrated at 62 to place it at ground potential. The other terminal end 36 of the central conductor 35 is connected to a tuning capacitor 32 with the outer capacitor plates being welded at 63 to the conductive outer surface 61 of the board 60 to provide a ground connection.

An input and an output connection 37 and 38, respectively, are secured to the end resonators 31' through a port 40 which exposes an end section 41 of a central conductor 35 whereby the input and output connecting wire 42 can be soldered to the center conductor 35 at a predetermined distance from the weld 62 so that the wire end section 41 provides an input and output internal impedance for the filter. It is also pointed out that the filter may be of the fixed type and the tuning capacitors 32 would then be fixed capacitors for fixing the frequency of the bandpass filter.

The low-pass filter 50, as shown in FIGS. 5 and 6, shows the usefulness of the design approach for constructing a wide band filter. This filter was designed using coaxial cable lengths 51 which were cut from 50 ohm coaxial cable used for transmission lines. The line sections 51 have the terminal ends 53 of their center conductors connected to chip capacitors 52 which are in turn connected to ground potential, as illustrated at 54. Input and output end connectors 55 and 56 respectively consist of short cable lengths, as shown in FIG. 6, connected to the end terminals 53' of the outer end ones of the cable lengths 51. The inductor provided by the sections of 50-ohm coaxial cables and the chip capacitors gives the transmission zeroes to complete the circuit. The chip capacitors 52 are herein connected to the circuit board 57.

Figure 7:
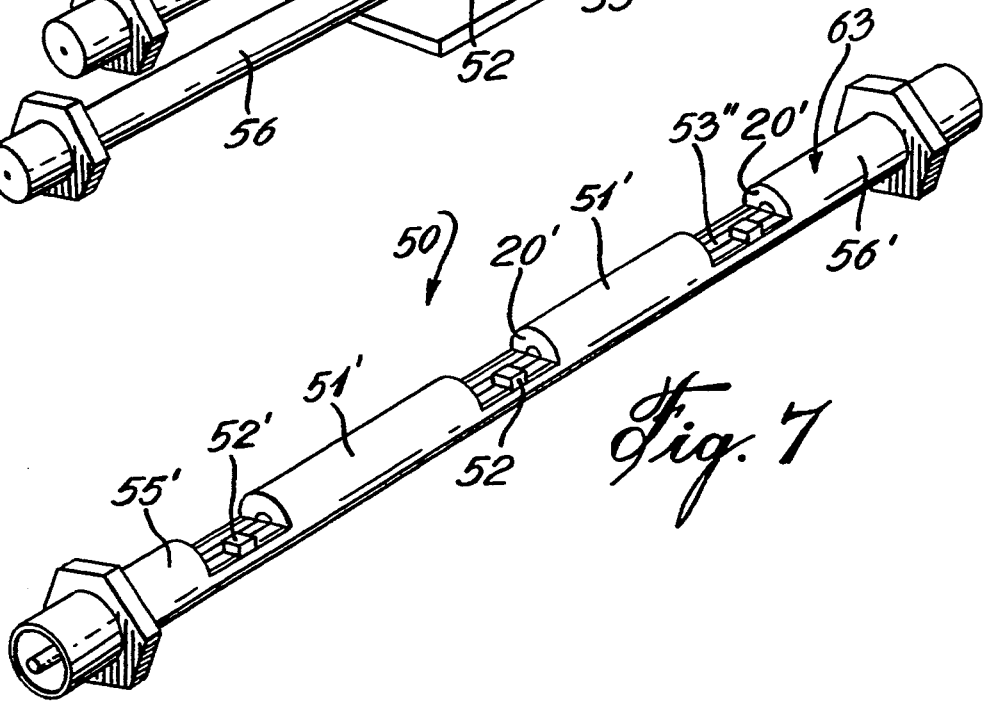
FIG. 7 is a perspective view showing an alternative construction of the low pass filter of FIG. 5.

FIG. 7 illustrates another embodiment of the construction of the wide band filter 50 using my coaxial cable technology. As herein shown, the cable lengths 51' are defined in a single length cable 63 by the cable lengths between window openings 20' cut in the cable 63. The chip capacitors 52' are mounted in the window openings and connected to the center conductor 53''. End connectors 55' and 56' are defined by the end sections of the cable.

It is pointed out that other filter circuits, such as low-pass, high-pass, or stop-band filter circuits can be constructed using my coaxial cable technology. Circuits can be interconnected to perform functions as complex as desired. Various other electronic circuit applications can also be utilized and the examples of the preferred embodiment described herein only illustrate typical examples of the use of this technology. It is therefore intended to cover many other component structures or electronic circuit configurations, provided such fall within the scope of the appended claims.

I claim:

1. A coaxial cable based electronic component or circuit comprising one or more coaxial cables each having an inner conductor surrounded by an insulating material and an outer conductive electrical shielding sleeve about said insulating material, and open section or sections of predetermined size in said outer conductive shielding sleeve, said insulating material in said open section or sections being partly removed to expose said inner conductor to connect thereto an electronic component or electronic circuit, said inner conductor also providing an interconnection from said electronic component or circuit to a further electrical element, said insulating material and said outer conductive electrical shielding sleeve forming at least part of an electrically insulating support and electrical shield for said electronic component or electronic circuit, said conductor having opposed terminal ends for electrical connection.

2. A coaxial cable based electronic circuit as claimed in claim 1 wherein said electronic component or circuit has an input and output, said inner conductor being cut to provide a space to define opposed terminal ends, one of said opposed terminal ends being connected to said input of said electronic component and the other of said opposed terminal ends being connected to said output.

3. A coaxial cable based electronic circuit as claimed in claim 1 wherein said electronic component or circuit is connected between said inner conductor and said outer conductive shielding sleeve.

4. A coaxial cable based electronic circuit as claimed in claim 1 wherein said electronic component or circuit has an input and output and a required ground connection, said inner conductor being cut to provide a space to define opposed terminal ends, one of said opposed terminal ends being connected to said input of said electronic component, the other of said opposed terminal ends being connected to said output and the said ground connection being connected to said outer conductive shielding sleeve.

5. A coaxial cable based electronic circuit as claimed in claim 1 wherein said electronic component is another shielded cable having an inner conductor exposed at an end thereof and connected to said inner conductor of said one or more coaxial cables.

6. A coaxial cable based electronic circuit as claimed in claim 2 further comprising at least one additional electronic component or circuit connected to said inner conductor of said one or more coaxial cables.

7. A coaxial cables based electronic circuit as claimed in claim 1 wherein said inner conductor of two or more of said coaxial cables are connected to said electronic component means.

8. A coaxial cable based electronic circuit as claimed in claim 1 wherein a shielded housing is secured about said open section or sections and in contact with said outer conductive shielding sleeve, said housing shielding said electronic component or circuit and said exposed inner conductor, said housing having access means for access to said electronic component or circuit and said exposed inner conductor.

9. A coaxial cable based electronic circuit as claimed in claim 8 wherein said housing is a metal block having one or more cable receiving bores for receiving portions of one or more of said coaxial cables therein, a transverse opening in said metal block and communicating with said cable receiving bores, said coaxial cables being disposed in said cable receiving bores with said open section disposed in said transverse opening, and closure means to close said transverse opening and spaced from said electronic component means.

10. A coaxial cable based electronic circuit as claimed in claim 9 wherein said housing block is a rectangular block, said cable receiving bores being bored from side walls of said block, said transverse opening being a transverse through bore formed across opposed top and bottom walls of said block.

11. A coaxial cable based electronic circuit as claimed in claim 1 wherein conductive shielding is secured about said open section or sections and in contact with said outer conductive shielding sleeve, said shielding being comprised of metal welded to said outer conductive shielding sleeve and shielding said component means and said exposed inner conductor.

12. A coaxial cable based electronic circuit as claimed in claim 1 wherein conductive shielding is secured about said open section or sections and in contact with said outer conductive shielding sleeve, said shielding being comprised of a metal tube lid over said outer conductive shielding sleeve and shielding said component means and said exposed inner conductor..

13. A coaxial cable based electronic circuit as claimed in claim 1 wherein conductive shielding is secured about said open section or sections and in contact with said outer conductive shielding sleeve, said shielding being comprised of a metallic spring slid onto said outer conductive shielding sleeve and shielding said component means and said exposed inner conductor.

14. A coaxial cable based electronic circuit as claimed in claim 1 wherein each said one or more coaxial cables have shielded end connectors, said end connectors constituting an input and output connection for said electronic component means.

15. A coaxial cable based electronic circuit as claimed in claim 1 wherein said coaxial cables are bent or otherwise shaped to minimize space, or to conform to a space requirement.

* * * * *